US006520285B2

(12) United States Patent
Tobias

(10) Patent No.: US 6,520,285 B2
(45) Date of Patent: Feb. 18, 2003

(54) AUDIBLE TUNING APPARATUS FOR A MUFFLER

(76) Inventor: Mark Tobias, 11951 Crabapple Dr., Franktown, CO (US) 80116

( * ) Notice: Subject to any disclaimer, the term of this patent is extended or adjusted under 35 U.S.C. 154(b) by 0 days.

(21) Appl. No.: 09/944,928

(22) Filed: Aug. 31, 2001

(65) Prior Publication Data

US 2002/0036114 A1 Mar. 28, 2002

Related U.S. Application Data

(60) Provisional application No. 60/229,207, filed on Aug. 31, 2000.

(51) Int. Cl.[7] ..... F01N 7/18

(52) U.S. Cl. ..... 181/241; 181/227; 181/252

(58) Field of Search ..... 181/241, 243, 181/227, 228, 236, 237, 248, 252, 256, 282

(56) References Cited

U.S. PATENT DOCUMENTS

| | | | | |
|---|---|---|---|---|
| 3,253,676 A | * | 5/1966 | Bottum | 181/241 |
| 3,563,338 A | | 2/1971 | Rader | |
| 4,537,279 A | | 8/1985 | Van Heeckeren | |
| 4,715,472 A | | 12/1987 | McKee | |
| 5,568,726 A | | 10/1996 | Yamada et al. | |
| 5,608,194 A | | 3/1997 | Okazaki et al. | |
| 5,743,088 A | | 4/1998 | Grath | |
| 5,959,263 A | | 9/1999 | Foltz, Jr. | |
| 6,367,580 B1 | * | 4/2002 | Chang | 181/241 |

* cited by examiner

*Primary Examiner*—Khanh Dang
(74) *Attorney, Agent, or Firm*—Dorsey & Whitney LLP

(57) ABSTRACT

An adjustable muffler system for a combustible engine including a muffler adapted for connection with an exhaust pipe of an engine, a blocking tube configured to be removably inserted within the muffler, and latch means adapted to removably secure the blocking tube within the muffler. In other embodiments, the blocking tube can include various holes or slots and may be telescoping or fabricated from multiple pieces.

33 Claims, 8 Drawing Sheets

9
7
26
18
12
24
30
28
20
32
55
38
54
48
34
40
44
22
37

AUDIBLE TUNING APPARATUS FOR A MUFFLER

CROSS REFERENCE TO RELATED APPLICATION

This application claims the benefit of U.S. provisional patent application No. 60/229,207, filed Aug. 31, 2000. The above-identified patent application is hereby incorporated by reference as if fully disclosed herein.

FIELD OF THE INVENTION

The present invention relates to an adjustable muffler for an engine exhaust system, and more particularly relates to a system and apparatus to tune the volume and type of sounds that are generated by the muffler.

BACKGROUND OF THE INVENTION

There are several measures of an engine's performance. There are power performance measures such as horsepower and torque. However, power performance measures are not readily discernible by the general public without specialized equipment such as a dynamometer. One measure of an engine's performance that is discernible by the general public is the sound or roar of an engine. The general public generally associates the volume level of an engine with the power level of an engine. Additionally, automobile, motorcycle, and engine enthusiasts recognize as favorable the type of sound emitted by a "hot rod", "muscle car", or "race car" type engine.

For the automobile, motorcycle, or engine enthusiast, it is important to optimize all measures of an engine's performance. Therefore, it is important to optimize the sound emitted from an engine's exhaust system. Optimization of an engine's sound includes both increasing the volume level and causing the sound quality to emulate that of a hot rod, muscle car, or race car. However, there are laws that prescribe acceptable noise levels for all types of engines operated in public areas. The noise levels that are deemed acceptable under the law are often below the volume levels that are considered optimum by automobile, motorcycle, or engine enthusiasts. A muffler system is typically attached to the ventilation discharge pipe of an engine to, in part, reduce engine noise levels to within acceptable standards. Generally, muffler systems alter and absorb the sound waves emanating from the ventilation discharge pipe to reduce the engine noise. However, the muffler systems that are widely available often fail to emit a desirable sound quality that emulates a hot rod, muscle car, or race car.

Muffler systems that provide a sound quality that emulates a hot rod, muscle car, or race car have been implemented in the past. One such system, called a "glasspack," includes a muffler body having a perforated inner tube with sound dampening media (i.e., a fiberglass or steel wool blanket) packed in between. Glasspacks and similar muffler systems are known by the automobile, motorcycle, or engine enthusiast to provide a desirable sound quality. However, current glasspack muffler systems and similar muffler systems are designed to generically muffle engine volume level to meet noise level laws and are not customizable for particular engines. Accordingly, current glasspack muffler systems often fail to meet an engine enthusiasts sound requirements, both volume and quality, for a particular engine because they are not customizable for the particular engine.

Adjustable muffler systems that allow the user to modify the sound waves emanating from the engine have also been implemented in the past. While these systems can provide engine sounds that are adjustable to optimum volume levels, these systems involve complicated designs that often negatively impact the engine's power performance or require additional maintenance.

Automobile, motorcycle, or engine enthusiasts often operate their respective vehicles at auto shows, races, or other events that are not on public roadways and therefore not subject to noise level laws or regulations. However, because they often have to utilize public roadways to transport their vehicles to such events, they must utilize muffler systems that keep the engine sound volume levels within the limits prescribed by law. There is a need for an adjustable engine muffler system that allows the automobile, motorcycle, and engine enthusiasts to customize engine sounds to optimum volume levels and to optimum sound quality levels. Furthermore, there is a need for an engine muffler that allows one to adjust or tune the sound volume level emitted and sound quality without negatively impacting the engine's power performance.

SUMMARY OF THE INVENTION

The present invention pertains to an adjustable muffler system for attachment to an engine exhaust system. More specifically, the present invention provides a novel and non-obvious adjustable muffler system that allows the user to customize engine sounds to optimum volume and quality levels, without negatively impacting the engine's power performance.

In the present invention, a simple, efficient apparatus and method of adjusting or tuning the volume level of the sounds emitted from an engine muffler without impacting the engine's power performance has been developed.

Generally, in the present invention, a blocking tube is used for removably inserting into the muffler housing and provides the user with a simple means for adjusting or tuning the amount of muffler capacity utilized, thereby allowing the user to adjust or tune the volume level and quality of the engine sounds emitted.

In the example of glasspack mufflers, sound dampening media absorbs the engine's exhaust pulses that pass through perforations in an inner tube. In the present inventive apparatus, a blocking tube operates to partially or fully block the perforations in the inner tube and provide a straight pipe flow path along the blocked section. Accordingly, the volume level and quality of the sounds emitted can be adjusted or tuned by varying the number of perforations blocked. This is accomplished in one embodiment by varying the length of the blocking tube. A very short blocking tube covers less perforations than a long blocking tube and therefore produces a sound with a lower volume level. A blocking tube that covers all of the perforations produces a straight pipe sound with the highest volume level.

In one embodiment of the present invention, the muffler system includes a housing having an exhaust receiving portion configured for attachment to a motorcycle exhaust pipe, an exhaust exiting portion opposite the exhaust receiving portion, a perforated tube interior to the muffler housing and extending from the exhaust receiving portion to the exhaust exiting portion, and sound dampening media packed between the muffler housing and the perforated tube. Also included is a non-perforated blocking tube movably positioned interior to the perforated tube. The blocking tube includes a free portion and a latched portion. The latched portion of the blocking tube is removably affixed to the exhaust exiting portion of the muffler housing and the free portion of the blocking tube is opposite the latched portion. Finally, the latched portion includes a means for removably securing the blocking tube with the muffler housing.

The foregoing and other features, utilities and advantages of the invention will be apparent from the following more particular description of a preferred embodiment of the invention as illustrated in the accompanying drawings.

DETAILED DESCRIPTION OF THE PRESENT INVENTION

Figure 1:
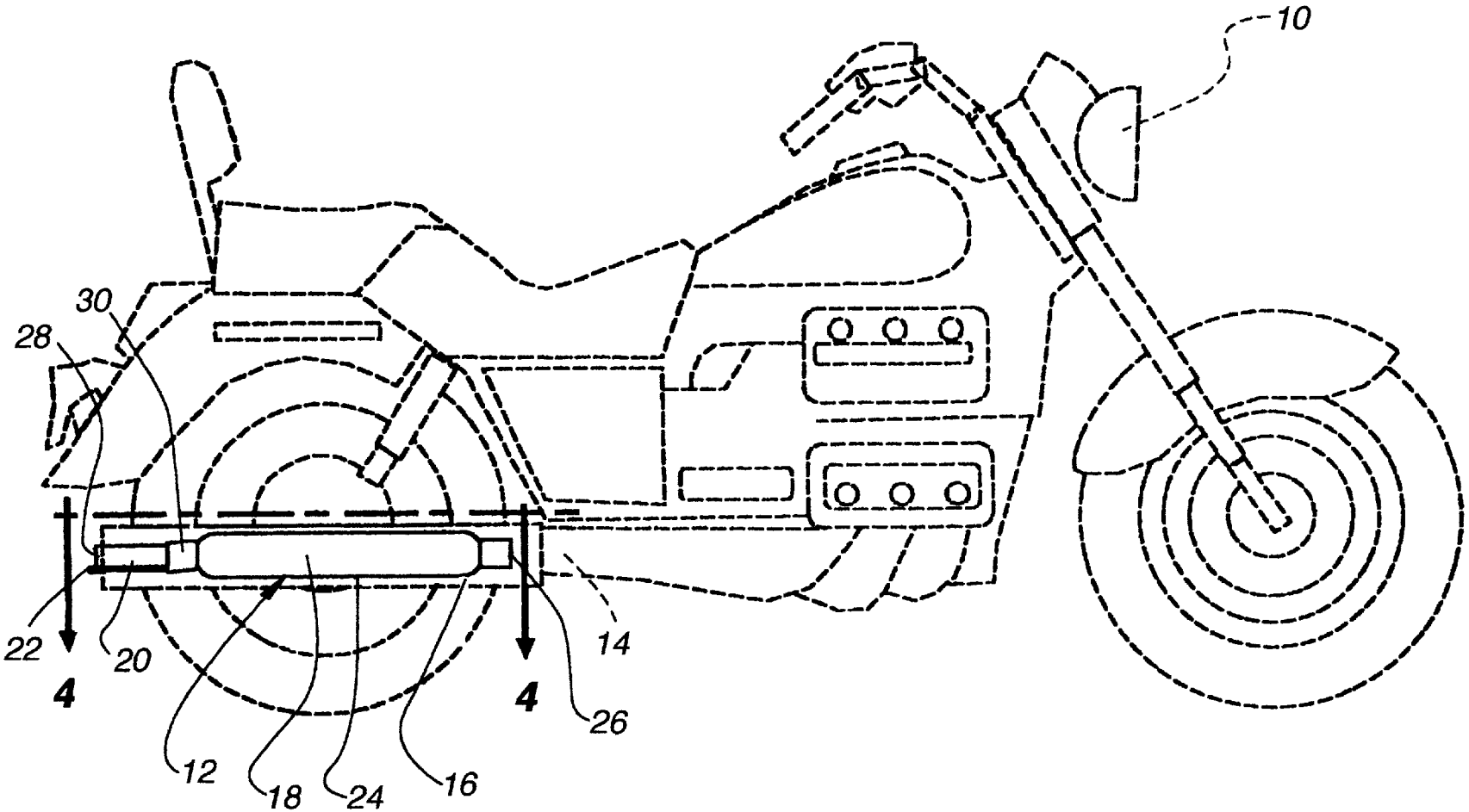
FIG. 1 is a side view of a motorcycle that includes the adjustable muffler of the present invention.

In one embodiment of the present invention described herein, the muffler system is attached to the exhaust system of a Honda Valkyrie motorcycle. However, the present invention muffler system can be used on other types of motorcycles and exhaust systems of other vehicles and engines generally.

FIGS. 1–18 illustrate various embodiments of the present inventive device. As shown in the drawings, one embodiment of the present invention muffler system includes a muffler having an outer housing and a perforated tubular inner wall extending the length of the outer housing, and being spaced away therefrom. Sound absorbing media (such as but not limited to a fiberglass or steel wool blanket) is packed between the housing and the tubular inner wall. The present invention also includes a blocking tube configured to be inserted into the muffler, inside the tubular inner wall. The blocking tube includes a mechanism for securing the blocking tube to the muffler housing to fix the position of the blocking tube with respect to the tubular inner wall.

In one embodiment of the present invention, the sound quality and volume level can be adjusted or tuned by varying the length of the blocking tube, which changes the number of perforations that are covered by the blocking tube. The more perforations that are covered, the higher the volume of the engine sounds emitted. The less perforations covered, the lower the volume of the engine sounds emitted.

FIG. 1 shows a motorcycle 10 with the present invention adjustable muffler system 12 attached to the engine exhaust pipe 14 and enclosed by the engine tail pipe 16. The muffler system 12 is attached to the exhaust pipe 14 and includes a muffler 18, blocking tube 20, and latch mechanism or means 22. The blocking tube 20 and latch means 22 are shown extending from the muffler housing 24. In FIG. 1, the front end 26 of the muffler 18 is attached to the engine exhaust pipe 14 and the rear end 28 is where the exhaust exits.

Figures 2, 3:
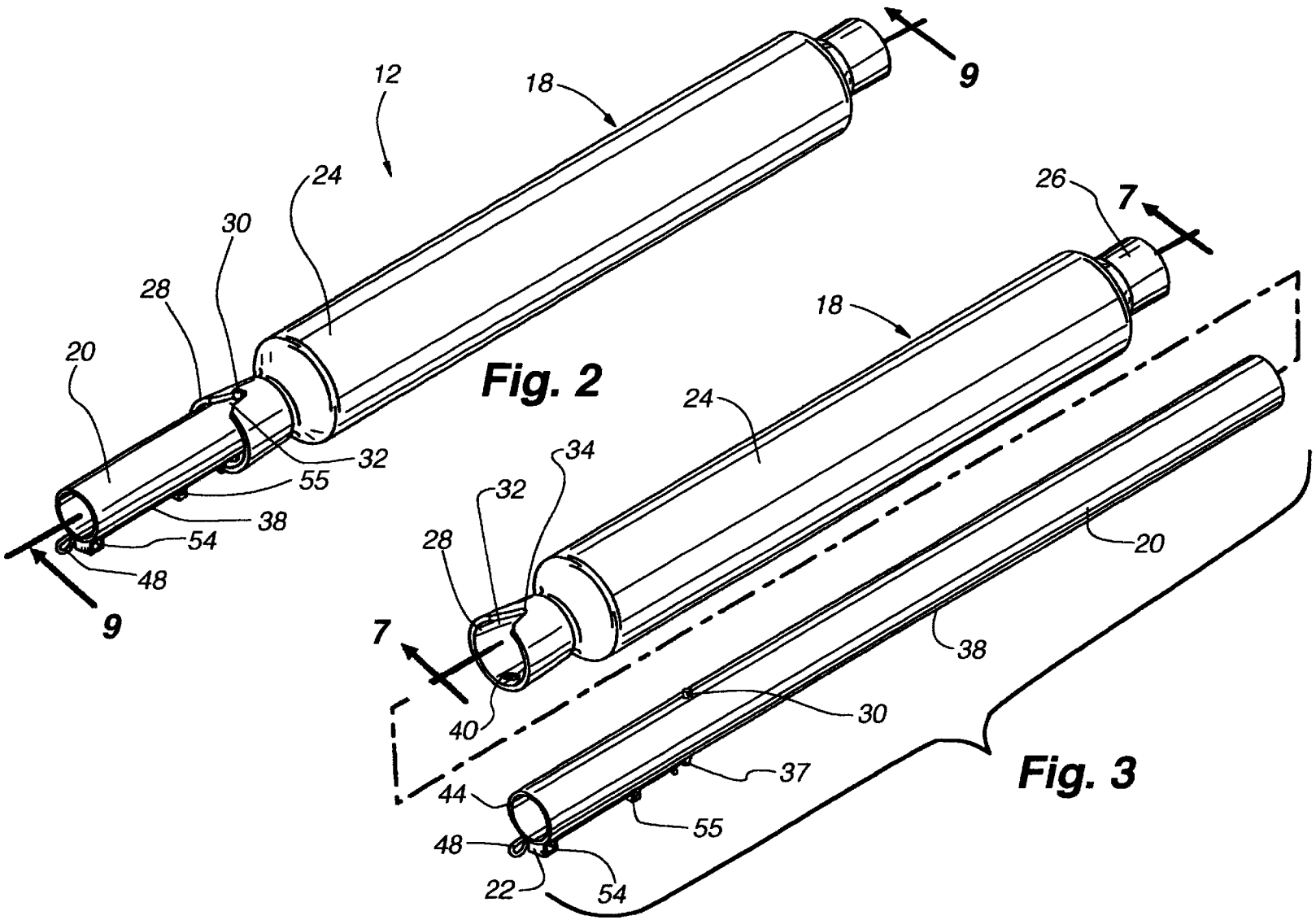
FIG. 2 is a perspective view of a muffler housing having a blocking tube visibly extending from one end.
FIG. 3 is an exploded view of a muffler housing and a blocking tube.

As shown in FIG. 2, the blocking tube 20 is inserted into the notched rear end 28 of the muffler 18. The blocking tube 20 can be guided into place blindly by matching the locator pin 30 on the blocking tube 20 with the positioning notch 32 in the rear end 28 of the muffler 18. Because the present invention muffler system 12 is at least partially enclosed by the engine tail pipe 16, the ability to install or remove the present invention muffler system 12 by touch and not sight is advantageous. The positioning notch 32 in the rear end 28 of the muffler 18 is v-shaped and guides the locator pin 30 to the vertex 34, which positions the latch means catch 37 in the appropriate location to attach to the muffler 18 and connect the blocking tube 20 to the muffler 18. Also shown in FIG. 2, a latch means 22 for securing the blocking tube 20 to the muffler housing 24 is attached to the bottom 38 of the blocking tube 20, opposite the locator pin 30. The latch means 22, however, could be at any offset location with respect to the locator pin 30.

In FIG. 3, the muffler 18 and blocking tube 20 are shown with the blocking tube 20 extracted from the muffler 18. As can be seen in FIG. 3, the blocking tube 20 includes a latch means catch 37 opposite the blocking tube locator pin 30. The muffler housing 24 includes a hole 40 opposite the notched portion 32 of the muffler housing end 28 configured to receive the latch means catch 37. As shown in later figures, the latch means catch 37 is positioned in the hole 40 when the blocking tube 20 is properly positioned in the muffler 18. The catch 37, when positioned in the hole 40, attaches the blocking tube to the muffler, and thus fixes its position with respect to the muffler. Actuating the end of the latch means 22 causes the latch means catch 37 to disengage the hole 40 to allow for removal of the blocking tube 20 from the muffler housing 24.

Figure 4:
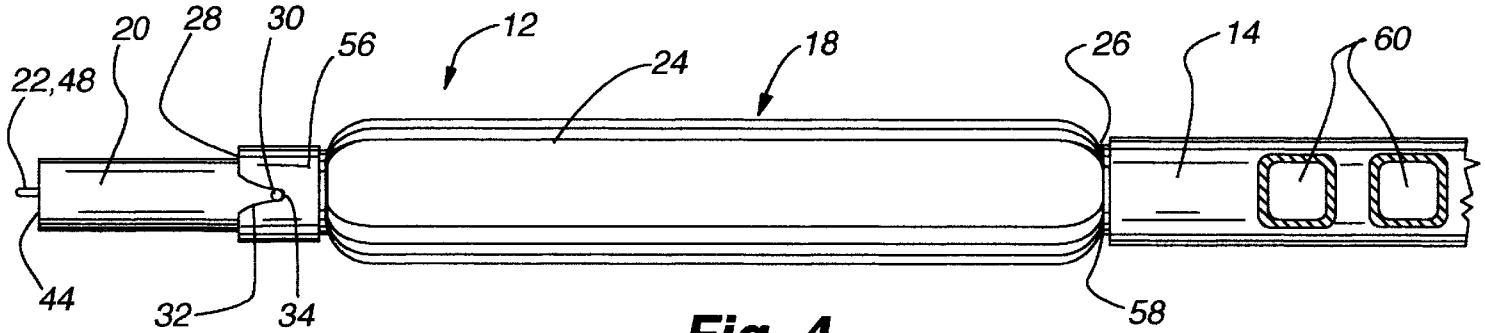
FIG. 4 is a plan view of a muffler housing with one end attached to an engine exhaust system and a portion of the blocking tube extending from the opposite end.
Figure 5:
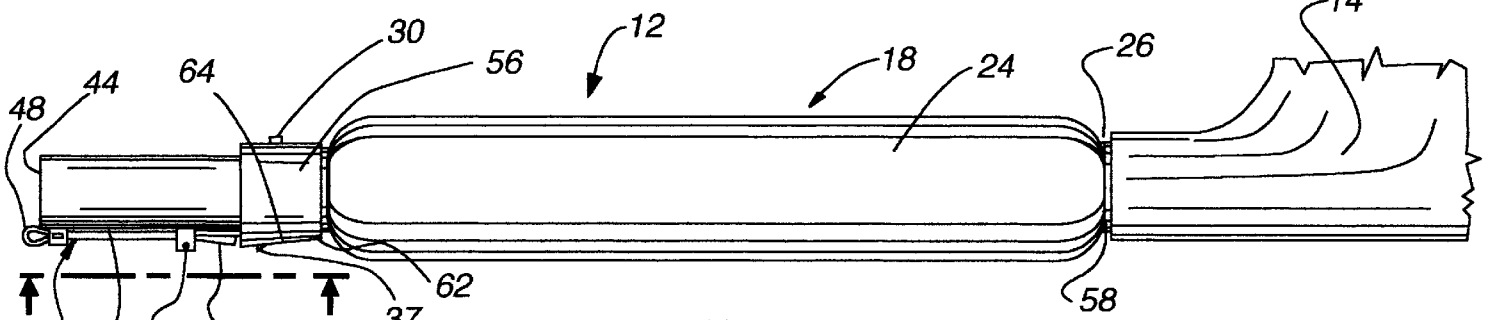
FIG. 5 is a side view of a muffler housing with one end attached to an engine exhaust system and a portion of the blocking tube extending from the opposite end.
Figure 6:
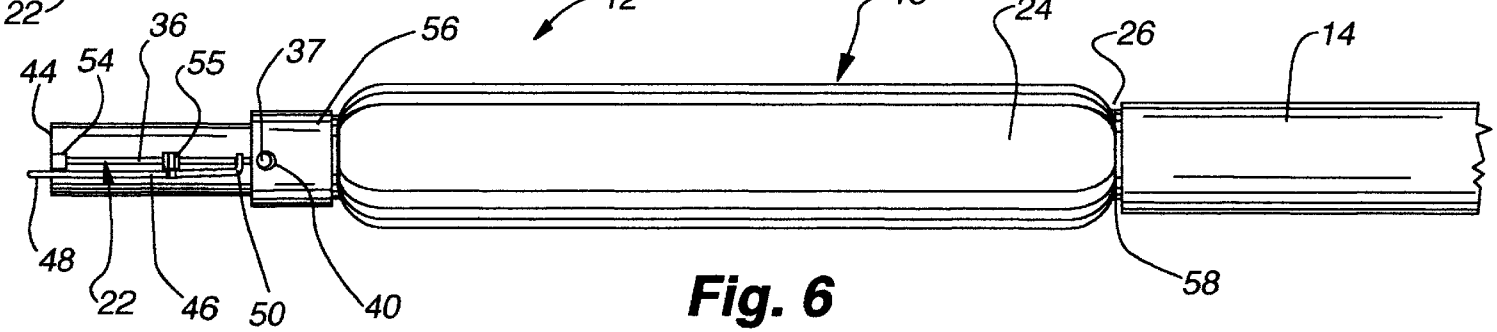
FIG. 6 is a bottom view of a muffler housing with one end attached to an engine exhaust system and a blocking tube extending from the opposite end.

FIGS. 4–6 show plan, side, and bottom views of the muffler system 12 attached to the engine exhaust pipe 14. In FIGS. 4–6, the blocking tube 20 is latched to the muffler housing 24.

FIG. 4 shows a plan view with the blocking tube locator pin 30 residing in the positioning notch 32. This indicates that the blocking tube 20 is securely latched with the muffler housing 24. In FIG. 4, a portion 48 of the latch means 22 extends past the rear end 44 of the blocking tube 20. The latch means 22 includes a catch release member 46 having a looped end 48 and an "L" shaped end 50, and a catch member 36 having a fixed end 54 and a catch 37 on the opposite end. Although the embodiment illustrated in FIG. 4 includes a catch release member 46 having a looped end 48 and an "L"-shaped end 50, other shaped ends are within the scope of the present inventive device providing they serve a similar function. For example, both ends of the catch release member 46 could be L-shaped. The catch release member 46 is pivotally fixed about ⅓ the distance between the L-shaped end 50 and the looped end 48 with the blocking tube 20 at or about the midpoint 55 of the catch member 36. The catch member 36 is biased in the latched position. Accordingly, when the blocking tube 20 is properly positioned within the muffler 18, the biased catch 37 automatically engages the hole 40 in the end collar 56 of the muffler 18. The catch 37 is disengaged by manipulating the looped end 48 of the latch release 46. The muffler 18 is attached to the engine exhaust pipe 14 at the front end 26 of the muffler 18.

In the embodiment shown in FIG. 4, the front collar 58 of the muffler housing 24 is configured to be inserted around the engine exhaust pipe 14. The present invention, however, includes any mechanism for effectively receiving the exhaust from the engine exhaust pipes 14 (e.g., the front collar 58 could be configured to fit within the engine exhaust pipe 14, etc.). FIG. 4 shows two engine exhaust inlets 60 on the engine exhaust pipe 14. The present invention muffler system 12 can be attached to engine exhaust pipes 14 having any number of engine exhaust inlets 60.

FIG. 5 shows a side view with the blocking tube 20 securely latched to the muffler 18. As shown in FIG. 5, when the blocking tube 20 is latched, the blocking tube locator pin 30 extends up (protrudes outwardly away from the center of the blocking tube 20) and resides in the vertex 34 of the positioning notch 32 in the rear end collar 56 of the muffler housing 24. Additionally, the latch means catch 37 extends forward down through the hole 40 (the catch 37 extends away from the center of the blocking tube 20) in the bottom 62 of the rear end collar 56. In the embodiment shown in FIG. 5, the rear end collar 56 is angled downward from the muffler housing 24 towards the looped end 48 of the latch means 22 to facilitate receipt of the latch means catch 37. The rear end collar 56 generally has a modified circular cross-section (i.e., a circle with a flared portion 64) for reducing wear on the catch member 36, but does not have to be flared. The present invention includes various mechanisms for latching the blocking tube 20 to the muffler housing 24 including where the bottom 62 of the end 56 of the cylindrical housing 24 has no angle. For instance, in FIG. 15 (discussed later), an enlarged bottom view of the latch means 22 is provided. In the embodiment illustrated in FIG. 5, the blocking tube 20 is fixed to the muffler housing 24 at the end collar 56 using the locator pin 30 and latch means 22 that extend outwardly (away from the center of the blocking tube 20) from the surface 21 of the blocking tube 20. In other embodiments, the locator pin 30 and latch means 22 could extend from the interior surface of the muffler housing 24 end collar 56 toward the surface 21 of the blocking tube 20. In addition, myriad configurations of the connection between the blocking tube 20 and muffler housing 24 are included in the present inventive device.

FIG. 6 shows a bottom view with the blocking tube latch means catch 37 residing in the muffler housing end hole 40. As mentioned previously, further details of the latch means 22 are provided later in the discussion of FIG. 15.

Figure 7:
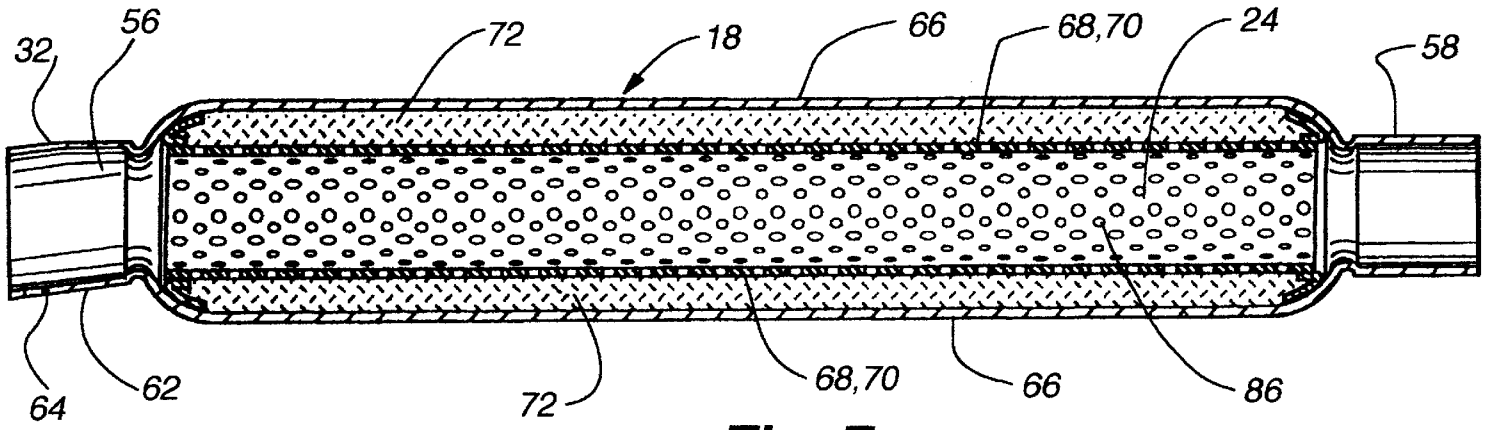
FIG. 7 is a section view taken along line 7—7 of FIG. 3, showing a muffler housing having sound dampening media packed between the housing and a perforated inner tube, a forward collar, and an end collar having a notch.

In FIG. 7, a side view section of the muffler 18 is provided. In the embodiment shown in FIG. 7, the muffler 18 includes a housing 24 forming a generally tubular outer sidewall 66, an inner tubular wall 68 having perforations 86 and a sidewall thickness 70, and sound dampening media 72 located between the housing sidewall 66 and the inner tubular sidewall 68. The housing 24 has a collar at its front end 58 and its rear end 56. As illustrated on FIGS. 2–6, the rear end collar 56 of the muffler housing 24 receives the blocking tube latch means 22. A portion 64 of it is angled downwardly to facilitate receipt of the latch means catch 37. Also, in the embodiment illustrated in FIG. 4, the positioning notch 32 in the rear end collar 56 is diametrically opposite the latch means 22.

Figure 8:
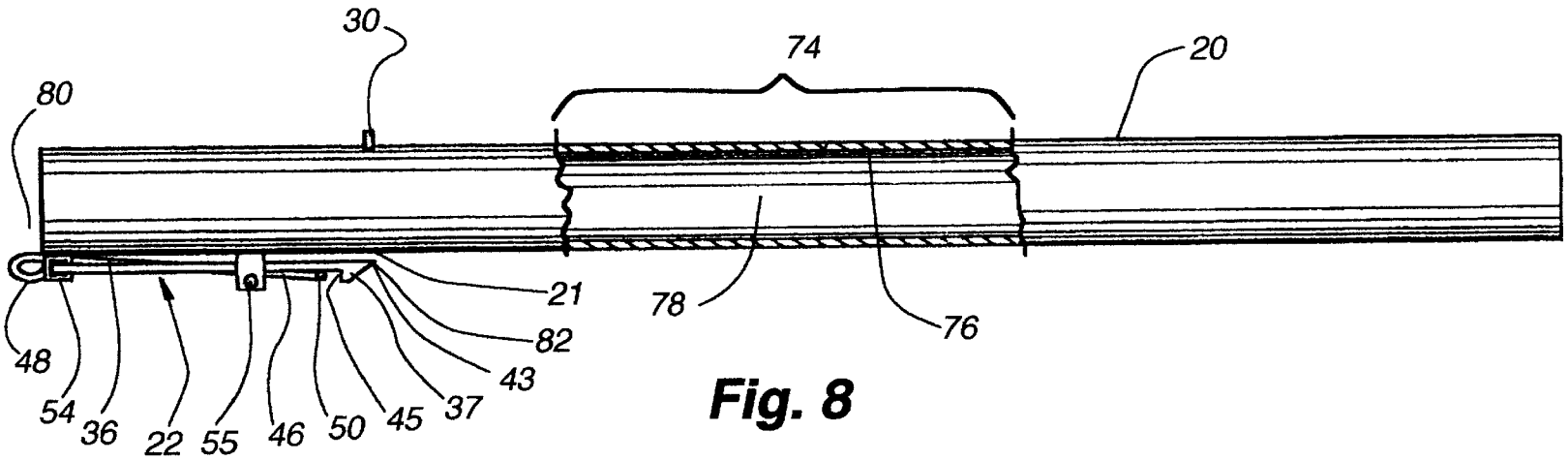
FIG. 8 is a side view and a section cut-away view of the blocking tube.

FIG. 8 shows a side view of the blocking tube 20 with a cut-away section of the center portion 74 of the blocking tube 20. The cut-away section shows a tube sidewall thickness 76 and smooth inside walls 78. Also, FIG. 8 shows a side view of the latch means 22. The latch means 22 includes the catch release member 46 and the catch member 36. The catch member 36 is attached to the tube surface 21 adjacent the rear end of the blocking tube in a cantilever manner at the catch member's rear end 80 which is fixed portion 54, and the front end portion 82 extends forwardly to include catch 37. The catch member 36 can be oriented to angle away from the surface 21 of the blocking tube 20 from the fixed portion 54 to the catch 37. The catch member 36 passes through the release member pivot mount 55. In one embodiment, only the rear end 80 of the catch member 36 is fixed to the surface 21 of the blocking tube 20 (at fixed portion 54). The remaining portion of the catch member 36 is biased so as to reside above and exterior to the surface 21 of the blocking tube 20. The catch 37 on the front end 82 of the catch member generally includes a wedge-shape. The leading edge 43 of the catch 37 angles up and away from the surface 21 of the blocking tube (outwardly from the center of the blocking tube 20) to create a thin leading edge 43. The thin leading edge 43 of the catch 37 helps the catch 37 slide into the muffler housing 24.

As can be seen in FIG. 8, the catch member 36 is spaced above the surface 21 of the blocking tube 20, and is biased in this position by the fixed manner in which the rear end 80 is attached to the collar 56. Further details of the latch means 22 are provided below in the discussion of FIG. 15. In the embodiment shown in FIG. 8, the blocking tube locator pin 30 is aligned with the catch 37 along the end of the tube 20. As illustrated in FIGS. 2–6, when the catch 37 is engaged by the hole 40 in the muffler housing 24, the pin 30 resides in the vertex 34 of the notch 32 in the rear end 28 of the muffler 18. In other embodiments, the locator pin 30 and catch 37 may not be aligned depending on the configuration of the positioning notch 32 and the hole 40 in the rear end collar 56 of the muffler housing 24.

Figure 9:
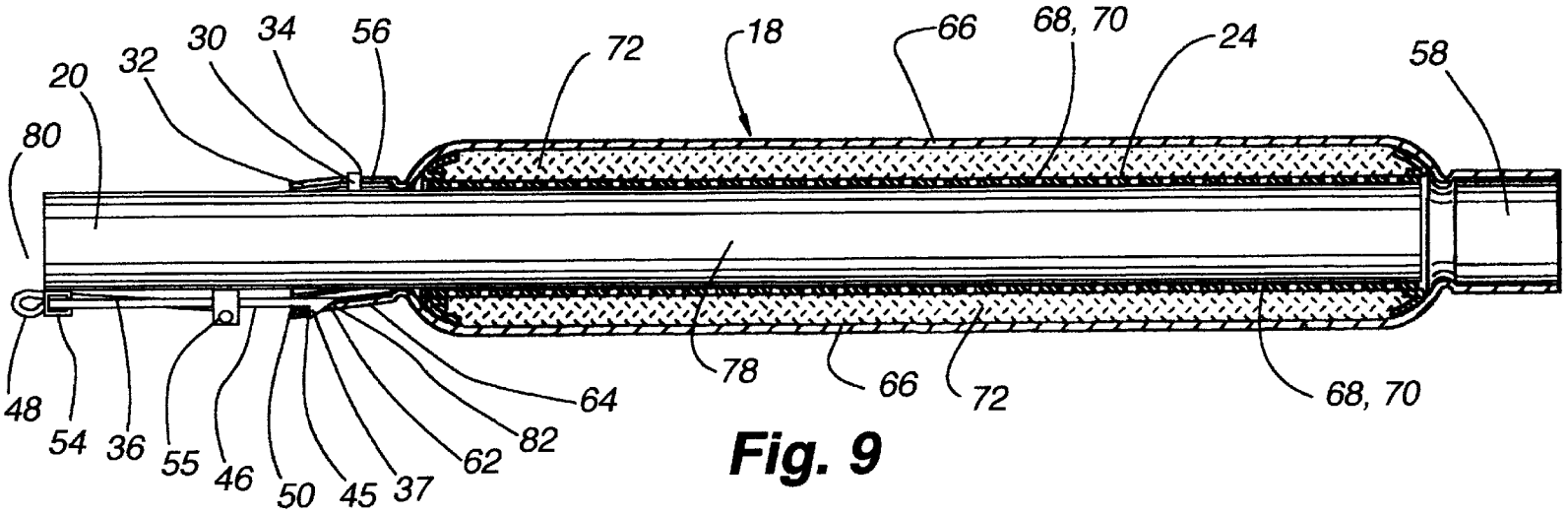
FIG. 9 is a section view taken along line 9—9 of FIG. 2, showing a muffler housing with a full-length, fully-inserted blocking tube.
Figure 10:
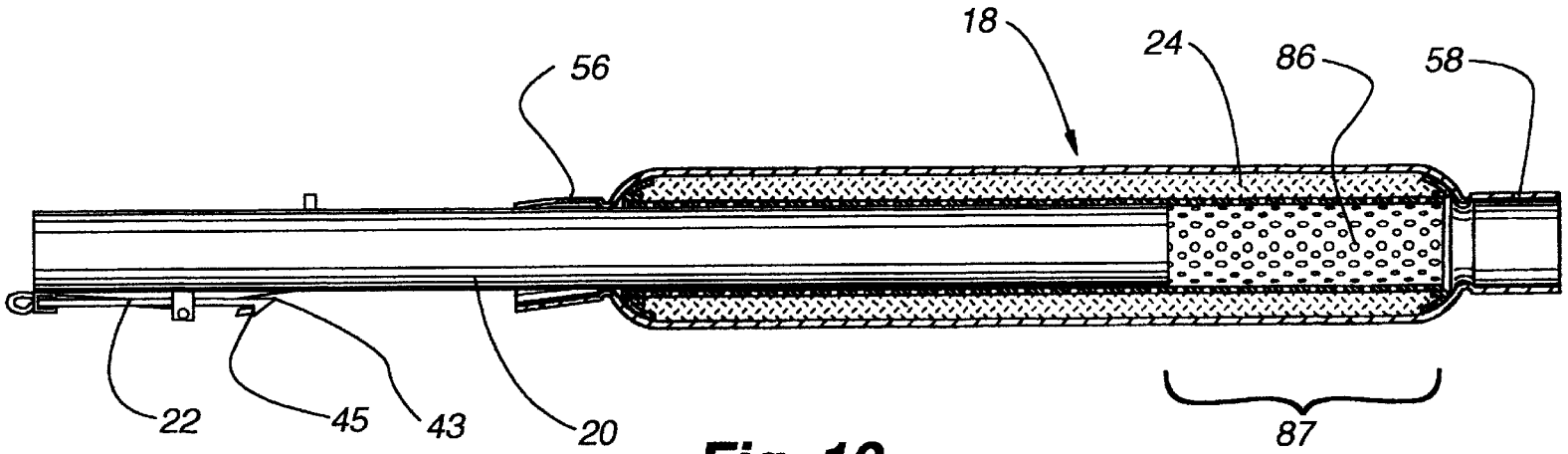
FIG. 10 is a section view, similar to FIG. 9, of a muffler housing with a full-length, half-inserted blocking tube.
Figure 11:
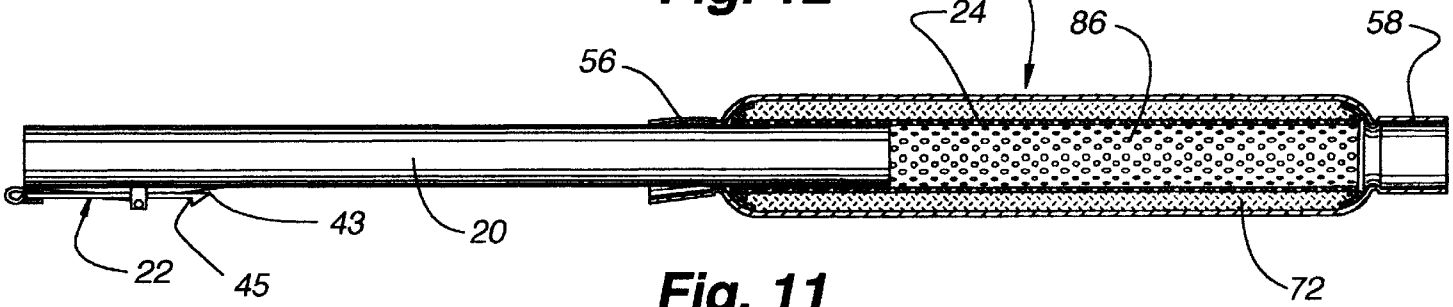
FIG. 11 is a section view, similar to FIG. 9, of a muffler housing with a full-length, one-quarter-inserted blocking tube.

FIGS. 9–11 show side view sections of the muffler housing 24 with a full-length blocking tube 20 fully, half, and one-quarter inserted.

In the FIG. 9 arrangement, a full-length blocking tube 20 is fully inserted and latched. The locator pin 30 on the blocking tube 20 is shown to be positioned at the vertex 34 of the notch 32 on the muffler housing 24 and the latch means catch 37 extends through the hole 40 in the bottom 62 of the muffler housing end 56 indicating a latched position. The absence of exposed perforations 86 (see FIG. 7) makes it clear that the blocking tube 20 is full-length and fully inserted. The FIG. 9 arrangement effectively converts the muffler system 18 to a straight pipe system by completely by-passing the muffler system 18 through the muffler 18.

FIG. 10 shows a full-length blocking tube 20 in an un-latched, half-inserted position. In FIG. 10, half 87 of the perforations 86 in the muffler housing inner tube 68 can be seen while the other half are covered by the blocking tube 20. If latched in this position, this would create a more muffled sound than the arrangement in FIG. 9.

In FIG. 11, the blocking tube 20 is un-latched and one-quarter-inserted. In FIG. 11, three-quarters of the muffler housing inner tube perforations 86 are uncovered. If latched in this position, this would create a more muffled sound than the arrangements in FIGS. 9 and 10.

Relative to one another, the arrangement shown in FIG. 9 provides the highest engine sound volume level, followed by FIGS. 10 and 11 in decreasing volume level. In FIG. 7, with the blocking tube 20 fully removed, the lowest volume level is achieved. There is a direct relationship with respect to the number of muffler housing inner tube perforations 86 that are covered by the blocking tube 20 and the engine sound volume level. The more perforations 86 that are covered, the higher the volume level. Accordingly, by changing the position of the blocking tube 20 within the muffler housing 24 the volume level may be raised or lowered as desired. In addition to modifying the volume level, changing the blocking tube 20 orientation allows the engine sound quality to be customized. When the desired volume level, sound quality level or both are tuned to the user's satisfaction (by loosely positioning the blocking tube in the muffler, such as is shown in FIGS. 9, 10 and 11), then the blocking tube 20 may be cut to the appropriate length, inserted in the muffler housing 24, and latched to the muffler housing 24. In this manner, the user can utilize the present invention to optimize the sound of the engine to their desired level. In addition, insertion of the blocking tube 20 into the muffler housing 24 does not negatively impact the performance of the engine.

Figure 12:
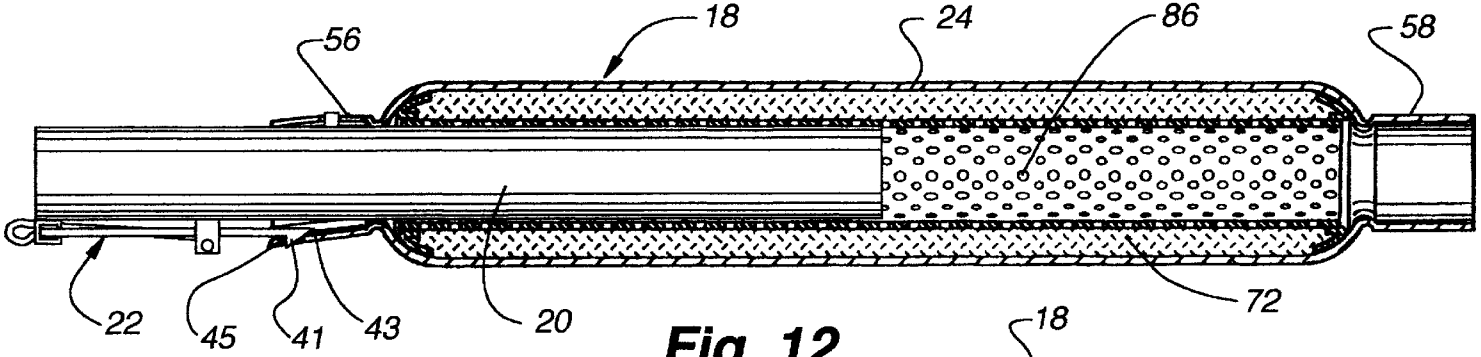
FIG. 12 is a section view, similar to FIG. 9, of a muffler housing with a three-quarter-length, fully-inserted blocking tube.
Figure 13:
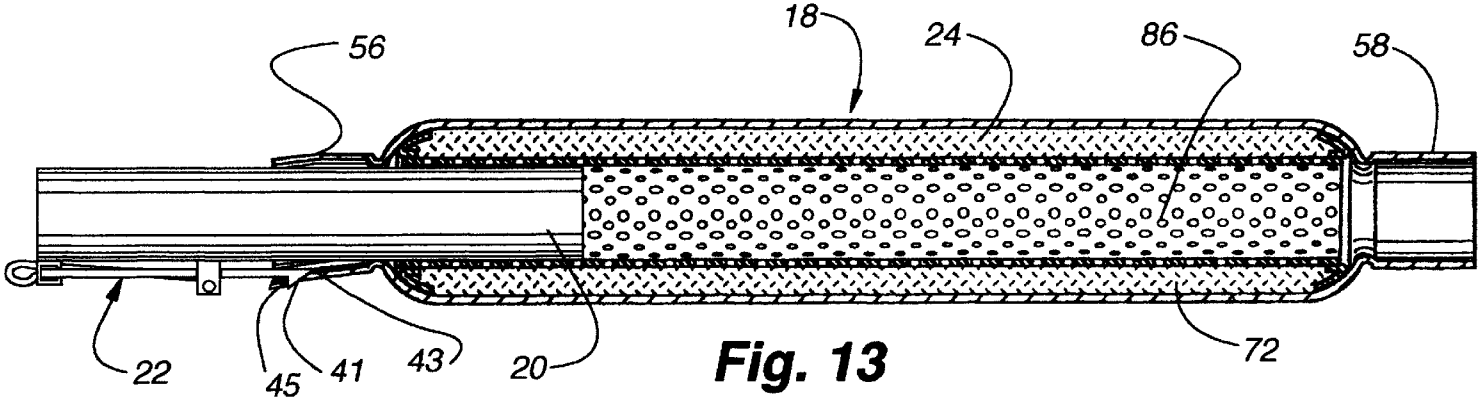
FIG. 13 is a section view of a muffler housing with a partial-length, fully-inserted blocking tube.
Figure 14A:
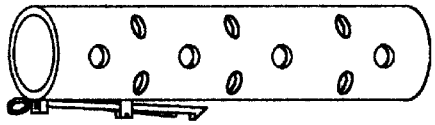
FIGS. 14*a*–14*e* illustrate additional blocking tube embodiments.
Figure 14B:
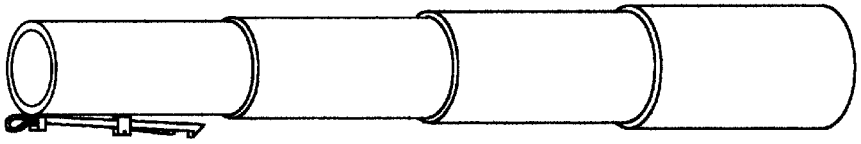
Figure 14C:
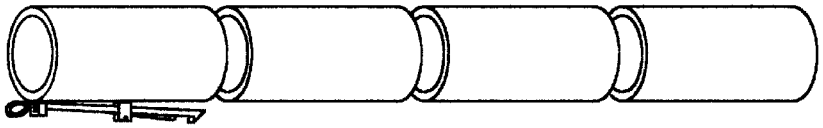
Figure 14D:
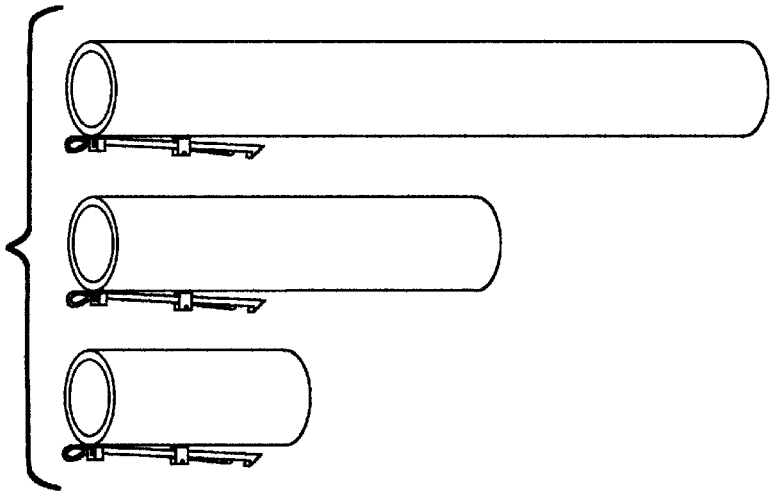
Figure 14E:
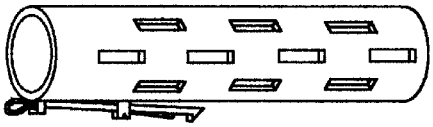

FIGS. 12–13 show arrangements having shortened blocking tubes 20 in a latched position. In FIG. 12, a half-length blocking tube 20 is fully inserted and latched. Only half of the muffler housing inner tube perforations 86 are covered in FIG. 12. For example, if the optimized engine sound is achieved with the blocking tube 20 in the position shown in FIG. 10, then the tube 20 would be cut and inserted into the muffler housing 24 as shown in FIG. 12. In FIG. 13, a one-quarter-length blocking tube 20 is fully inserted and latched. Only one-quarter of the muffler housing inner tube perforations 86 are covered in FIG. 13.

In both FIGS. 12 and 13, the position of the blocking tube locator pin 30 and the latch means catch 37 indicate that the blocking tube 20 is in a latched position.

FIGS. 14*a*–14*e* illustrate additional blocking tube modes. Further modes could be made by including a shaped blocking tube having various-shaped, sized and spaced holes in the blocking tube (FIG. 14*a*), having a telescoping blocking tube (FIG. 14*b*), having a multi-piece adjustable blocking tube (FIG. 14*c*), and having multiple blocking tubes (FIG. 14*d*), etc. In addition, another embodiment includes one tube that fits closely within a second tube, with both tubes having slots cut in them that will allow tuning the sound by rotating the two tubes with respect to each other. Thus, changing the alignment of the slots and subsequently the amount of sound waves allowed to pass through their two walls into the muffling chamber. A locking device secures the position once the optimum sound is achieved.

While the embodiments shown and described in the figures included herein refer to muffler housings and blocking tubes that have a generally round cross-section (i.e., blocking "tube", inner "tube", etc.), the present invention includes any conceivable cross-sectional shape, such as but not limited to: square; rectangular; triangular; oval; irregular; or C-shaped.

Figure 15:
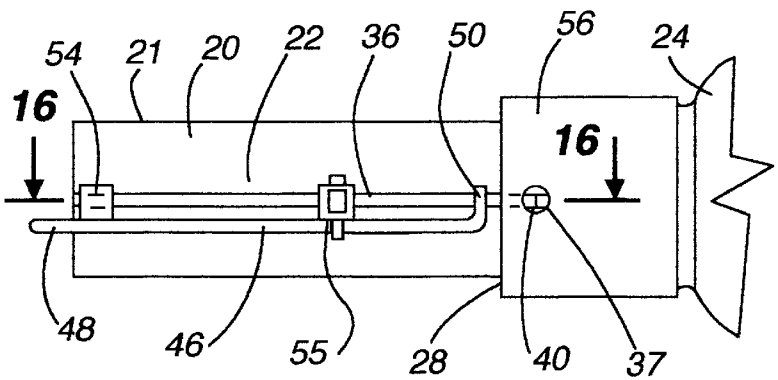
FIG. 15 is a bottom view of a latch means on the rear end of the blocking pipe connected to the end collar of the muffler housing.

A bottom view of the muffler housing end 56 and the blocking tube 20 with the latch means 22 extending from the housing 24 is shown in FIG. 15. The latch means 22 includes a catch release member 46 and a catch member 36. The catch release member 46 has a looped end 48 and an "L" shaped end 50 and is pivotally attached to the blocking tube surface 21 at or about the catch release member midpoint 55. The L-shaped end 50 is bent to rest on the catch member 36. In one embodiment, the L-shaped end 50 bends at a 90° angle with respect to both the catch release member 46 and the catch member 36. In other embodiments, the L-shaped end may bend at angles other than 90° so long as it still engages the catch member 36. What is important is that there is a portion of the catch release member that engages the catch member, regardless of shape. The catch member 36 is fixed to the blocking tube surface 21 at one end 54, in a cantilever manner, and has a catch 37 on the opposite end. The catch member 36 extends along the outside of the tube 20 and is spaced away therefrom. It is biased to this position but can be deflected and return to this position.

Figure 17:
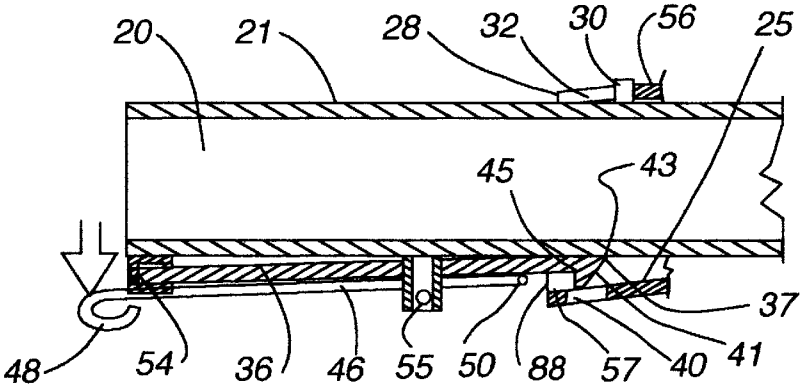
FIG. 17 is a section view of a latch means in a position where the latch is disengaged from the muffler housing.
Figure 18:
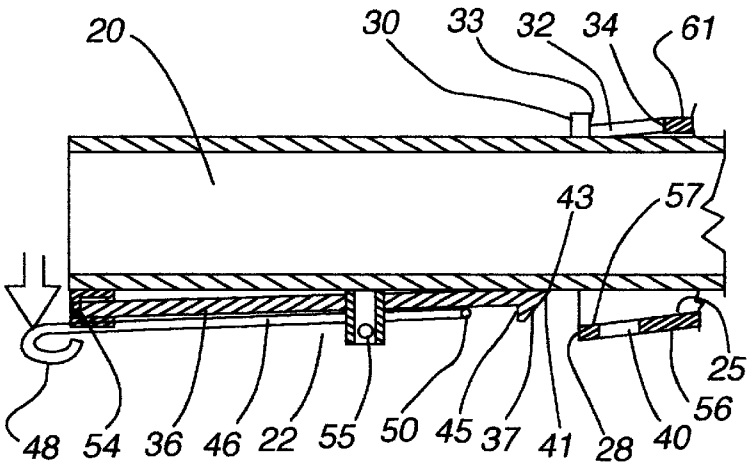
FIG. 18 is a section view of a latch means in a position where the latch is disengaged allowing the blocking pipe to be partially removed from the muffler.
Figure 16:
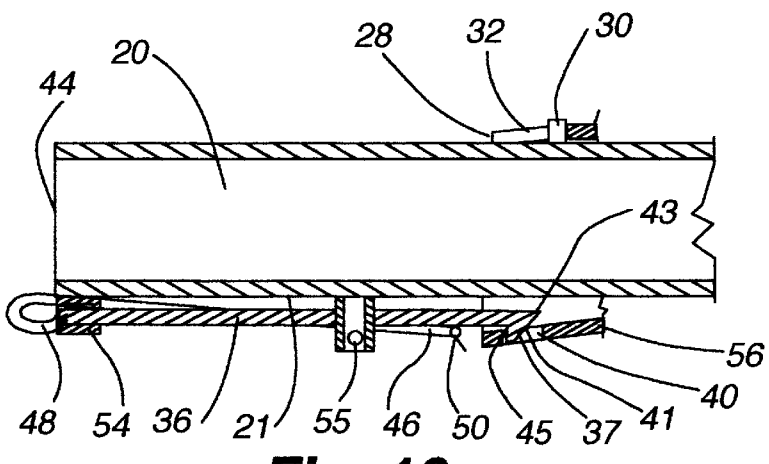
FIG. 16 is a section view taken along line 16—16 of FIG. 15 and shows a latch means connected to the end collar of the muffler housing in a latched position with the locator pin in the slot.

FIGS. 16–18 show side section views of one embodiment of the latch means 22 in various latch positions. FIG. 16 is a side section view of one embodiment of the latch means 22 in the latched position. In the latched position, the looped end 46 of the catch release member 46 rests on the surface 21 of the end 44 of the blocking tube 20 and the L-shaped end 50 of the catch release 46 rests on the catch member 36. The catch member 36 is fixed to the blocking tube surface 21 at the rear end 44 of the blocking tube 20 and slopes upwardly (outwardly from the center of the blocking tube) from the exhaust end 44 of the blocking tube 20 towards the catch end 37 of the catch member 36. In the latched position, the trailing edge 45 of catch 37 extends up (again, outwardly from the center of the blocking tube) through the hole 40 in the rear end 56 of the muffler housing 24.

When the user wants to insert the blocking tube 20 into the muffler housing 24, the user inserts the blocking tube 20 until the blocking tube locator pin 30 contacts the end 28 of the muffler housing 24. The user then rotates the blocking tube 20, if necessary, until the locator pin 30 slides into the notch 32 in the rear end collar 56 of the muffler housing 24. As the locator pin 30 slides along the notch 32, the catch member 36 deflects downwardly (or inwardly toward the center of the blocking tube 20) by the catch 37 engaging the collar 56 of the muffler. The v-shaped notch 32 serves to automatically guide the locator pin to it's vertex 34, which automatically locates the catch 37 with the hole 40 in the rear end collar 56 of the muffler housing 24. When the blocking tube locator pin 30 reaches the vertex 34 of the notch 32, the raised portion 45 of the latch means catch 37 will encounter the hole 40, and due to spring action, insert itself into the hole 40 in the rear end collar 56 of the housing 24. In more detail, the leading edge 43 and sloped surface 41 of the catch 37 engages the edge 57 of the collar 56 which pushes the catch 37 down (toward the center of the blocking tube 20 and beneath the edge 57 of the collar 56) to clear the rear end collar 56 and then the biasing force causes the catch end 37 to raise up and the right angle side 45 of the catch 37 engages the side of the hole 40.

FIG. 17 is a side section view of the blocking tube 20 and latch means 22 in a partially inserted position. In FIG. 17, the looped end 48 of the catch release member 46 is forced away from the blocking tube surface 21 thereby causing the L-shaped end 50 of the release member 46 to forcibly contact the catch member 36, causing the catch member 36 to deflect toward the surface 21 of the blocking tube 20. In this depressed position, the raised portion 45 of the catch 37 disengages from the hole 40 in the collar 56 and moves into the space 88 between the blocking tube surface 21 and the muffler housing sidewall surface 25.

When the user wants to remove the blocking tube 20 from the muffler housing 24, the user disengages the catch 37 by moving the looped end 48 of the catch release member 46 away from the blocking tube 20 as described above, thus disengaging the catch from the hole, and may then pull the blocking tube 20 out of the muffler housing 24. By moving the looped end 48 of the catch release member 46 radially away from the blocking tube 20, the user causes the catch 37 to disengage with the hole 40 on the rear collar 56 of the muffler housing 24. FIG. 17 shows the position of the catch member 36 and catch release member 46 immediately prior to removal.

FIG. 18 shows the latch means 22 when the blocking tube 20 is partially extracted from the muffler housing 24 and the catch release member 46 is fully disengaged. The blocking tube locator pin 30 is positioned at the beginning 33 of the notch 32 on the top 61 of the end 28 of the muffler housing 24 and the catch 37 is disengaged from the hole 40 in the muffler housing 24. In FIG. 18, the catch member 36 is deflected toward the blocking tube surface 21 from the force exerted on the L-shaped end 50 of the catch release member 46. In a fully extracted, resting position, the looped end 48 of the catch release member 46 would rest on the blocking tube surface 21 and the catch end 37 of the catch member 36 would extend above the blocking tube surface 21.

In addition to the latching means 22 illustrated in FIG. 18 and throughout all of the figures, additional latching mechanisms are contemplated. Any latching mechanism that removably attaches the blocking tube 20 within the muffler housing 24 is suitable although latching mechanisms that allow the user to install and remove the present inventive adjustable muffler system by touch rather than by sight are preferred. For example, it is conceivable that a nut and bolt arrangement could be utilized as the latching means for one embodiment of the present inventive device.

While the invention has been particularly shown and described with reference to a preferred embodiment thereof, it will be understood by those skilled in the art that various other changes in the form and details may be made without departing from the spirit and scope of the invention.

What is claimed is:

1. An adjustable muffler system for a combustible engine, said system comprising:

a muffler adapted for connection with an exhaust pipe of said engine;

a blocking tube configured to be removably inserted within said muffler; and latch means adapted to removably secure said blocking tube within said muffler.

2. The adjustable muffler system in claim 1, said muffler further comprising:

a muffler housing having a front end, a rear end opposite said front end, and a central portion between said ends.

3. The adjustable muffler system in claim 2, wherein:

said rear end includes a locator pin positioning notch and catch receiving hole, said receiving hole circumferentially opposite said notch.

4. The adjustable muffler system in claim 2, wherein:

said rear end includes a flared edge portion configured to removably receive said latch means.

5. The adjustable muffler system in claim 2, wherein:

said muffler housing is further comprised of a tubular outer sidewall, an inner tubular wall having perforations, and sound dampening media located between said outer sidewall and said inner tubular wall.

6. The adjustable muffler system in claim 1, wherein:

said blocking tube is a hollow, cylindrical body having a front open end in fluid communication with a rear open end.

7. The adjustable muffler system in claim 5, wherein:

said blocking tube is received within said perforated inner tubular wall to at least partially block said perforations.

8. The adjustable muffler system in claim 1, wherein:

said latch means is secured to an exterior surface of said blocking tube.

9. The adjustable muffler system in claim 6, wherein:

said blocking tube includes a protruding locator pin adjacent said rear end; and said muffler housing rear end includes a locator pin positioning notch adapted to receive said locator pin.

10. The adjustable muffler system in claim 8, wherein:

said latch means include a catch release member operably connected with a catch member.

11. The adjustable muffler system in claim 10, wherein:

said catch release member includes a looped end and an L-shaped end opposite said looped end;

said catch member includes a fixed end and a catch on the opposite end, said catch end of said catch member biased away from said exterior surface; and said catch release member is configured to pivot such that when said looped end is actuated said L-shaped end presses against said catch member to cause said catch member to move toward said exterior surface of said blocking tube.

12. A method for tuning the sound of an adjustable muffler system for use with a combustible engine, said method comprising:

providing a muffler having a front end, rear end and central portion between said ends;

providing a blocking tube having a rear end, a front end, and an exterior surface and configured to be removably inserted within said muffler;

inserting said front end of said blocking tube in said rear end of said muffler while said combustible engine is operating until a desired sound quality is achieved;

measuring a blocking tube blocking length equivalent to the length of said blocking tube extending in said muffler when said desired sound quality is achieved; and tailoring the overall length of said blocking tube to equal said blocking tube length.

13. A method for inserting a blocking tube in an adjustable muffler system for use with a combustible engine, said method comprising:

providing a muffler having a front end, rear end and central portion between said muffler ends, said rear end including a locator pin positioning notch and a catch receiving hole;

providing a blocking tube having a rear end, a front end, an exterior surface, a protruding locator pin adjacent said rear end and said blocking tube configured to be removably inserted within said muffler;

providing latch means connected with said exterior surface of said blocking tube adjacent said rear end, said latch means including a catch release member operably connected with a catch member, said catch release member including a looped end and an L-shaped end opposite said looped end, said catch member including a fixed end and a catch on the opposite end, said catch end of said catch member biased away from said exterior surface, said catch release member configured to pivot such that when said looped end is pulled said L-shaped end presses against said catch member to cause said catch member to move toward said exterior surface of said blocking tube, and inserting and rotating said front end of said blocking tube in said rear end of said muffler until said locator pin engages said locator pin positioning notch and said catch engages said catch receiving hole.

14. An adjustable muffler system for a combustible engine, said system comprising:

a muffler including a muffler housing having a front end, a rear end opposite said front end, and a central portion extending between said muffler ends, said muffler adapted for connection with an exhaust pipe of said engine;

a blocking tube configured to be removably inserted within said muffler; and latch means adapted to removably secure said blocking tube within said muffler.

15. The adjustable muffler system in claim 14, wherein:

said rear end includes a locator pin positioning notch and catch receiving hole, said receiving hole circumferentially opposite said notch.

16. The adjustable muffler system in claim 15, wherein:

said rear end includes a flared edge portion configured to removably receive said latch means.

17. The adjustable muffler system in claim 16, wherein:

said muffler housing is further comprised of a tubular outer sidewall, an inner tubular wall having perforations, and sound dampening media located between said outer sidewall and said inner tubular wall.

18. The adjustable muffler system in claim 17, wherein:

said blocking tube is received within said perforated inner tubular wall to at least partially block said perforations.

19. An adjustable muffler system for a combustible engine, said system comprising:

a muffler including a muffler housing having a front end, a rear end opposite said front end, and a central portion between said front and rear ends, said muffler adapted for connection with an exhaust pipe of said engine;

a blocking tube configured to be removably inserted within said muffler, said blocking tube having a front open end in fluid communication with a rear open end; and latch means adapted to removably secure said blocking tube within said muffler.

20. The adjustable muffler system in claim 19, wherein:

said blocking tube includes a protruding locator pin adjacent said rear end; and said muffler housing rear end includes a locator pin positioning notch adapted to receive said locator pin.

21. An adjustable muffler system for a combustible engine, said system comprising:

a muffler adapted for connection with an exhaust pipe of said engine;

a blocking tube configured to be removably inserted within said muffler; and latch means adapted to removably secure said blocking tube within said muffler; wherein said latch means are secured to an exterior surface of said blocking tube.

22. The adjustable muffler system in claim 21, wherein:

said latch means include a catch release member operably connected with a catch member.

23. The adjustable muffler system in claim 22, wherein:

said catch release member includes a looped end and an L-shaped end opposite said looped end;

said catch member includes a fixed end and a catch on the opposite end, said catch end of said catch member biased away from said exterior surface; and said catch release member configured to pivot such that when said looped end is pulled said L-shaped end presses against said catch member to cause said catch member to move toward said exterior surface of said blocking tube.

24. An adjustable muffler system for a combustible engine, said system comprising:

a muffler including a muffler housing having a front end, a rear end opposite said front end, and a central portion between said muffler ends, said muffler adapted for connection with an exhaust pipe of said engine, said rear end includes a locator pin positioning notch and catch receiving hole, said receiving hole circumferentially opposite said notch;

a blocking tube configured to be removably inserted within said muffler;

latch means including a catch release member operably connected with a catch member, said catch release member including a looped end and an L-shaped end opposite said looped end, said catch member including a fixed end and a catch on the opposite end, said catch end of said catch member biased away from said exterior surface, said catch release member configured to pivot such that when said looped end is pulled said L-shaped end presses against said catch member to cause said catch member to move toward said exterior surface of said blocking tube, said latch means secured to an exterior surface of said blocking tube; wherein when said blocking tube is inserted within said muffler, said notch receives said locator pin and said hole removably receives said catch.

25. The adjustable muffler system in claim 1, wherein:

said blocking tube includes at least one hole.

26. The adjustable muffler system in claim 1, wherein:

said blocking tube includes a rectangular cross-section.

27. The adjustable muffler system in claim 1 includes a square cross-section.

28. The adjustable muffler system in claim 1 includes a triangular cross-section.

29. The adjustable muffler system in claim 1 includes a non-circular cross-section.

30. The adjustable muffler system in claim 1 includes a c-shaped cross-section.

31. The adjustable muffler system in claim 1, wherein:

said blocking tube is telescoping.

32. An adjustable muffler system for a combustible engine, said system comprising:

a muffler including a tubular outer sidewall, a perforated inner tubular wall, and sound dampening media located between said outer sidewall and said inner tubular wall, said muffler adapted for connection with an exhaust pipe of said engine;

a blocking tube configured to be removably inserted within said inner tubular wall of said muffler; and latch means adapted to removably secure said blocking tube within said muffler.

33. A method for tuning the sound of an adjustable muffler system for use with a combustible engine, said method comprising:

providing a muffler having a front end, rear end and central portion between said ends, said muffler including a tubular outer sidewall, a perforated inner tubular wall, and sound dampening media located between said outer sidewall and said inner tubular wall;

providing a blocking tube having a rear end, a front end, and an exterior surface and configured to be removably inserted within said muffler;

inserting said front end of said blocking tube in said rear end of said muffler while said combustible engine is operating until a desired sound quality is achieved;

measuring a blocking tube blocking length equivalent to the length of said blocking tube extending in said muffler when said desired sound quality is achieved; and tailoring the overall length of said blocking tube to equal said blocking tube length.

* * * * *